US006044828A

United States Patent [19]

Matsushita

[11] Patent Number: 6,044,828

[45] Date of Patent: Apr. 4, 2000

[54] CRANKCASE VENTILATION FOR SMALL OUTBOARD MOTOR

[75] Inventor: Hideaki Matsushita, Hamamatsu, Japan

[73] Assignee: Sanshin Kogyo Kabushiki Kaisha, Japan

[21] Appl. No.: 09/150,987

[22] Filed: Sep. 10, 1998

[30] Foreign Application Priority Data

Sep. 30, 1997 [JP] Japan ..... 9-266495

[51] Int. Cl.[7] ..... B63H 21/26

[52] U.S. Cl. ..... 123/572

[58] Field of Search ..... 123/572, 573, 123/574

[56] References Cited

U.S. PATENT DOCUMENTS

| | | | |
|---|---|---|---|
| 4,459,966 | 7/1984 | Sakano et al. | 123/573 |
| 4,501,234 | 2/1985 | Tokoi et al. | 123/573 |
| 5,383,440 | 1/1995 | Koishikawa et al. | 123/572 |
| 5,501,202 | 3/1996 | Watanabe | 123/572 |
| 5,794,602 | 9/1998 | Kimura | 123/572 |

*Primary Examiner*—Marguerite McMahon
*Attorney, Agent, or Firm*—Knobbe, Martens, Olson & Bear, LLP

[57] ABSTRACT

A crankcase ventilation arrangement for an outboard motor that permits ventilating air and blowby gasses to flow from the crankcase chamber into an induction system of the engine for air purification. In addition, the arrangement is such that oil, which may flow into the ventilating system is separated so that it can return to the crankcase chamber.

13 Claims, 8 Drawing Sheets

CRANKCASE VENTILATION FOR SMALL OUTBOARD MOTOR

BACKGROUND OF THE INVENTION

This invention relates to an outboard motor and more particularly to an improved crankcase ventilation arrangement for an outboard motor utilizing a small four cycle engine.

Four-cycle engines are being considered seriously as replacements for the more conventionally utilized two-cycle engines as power plants in outboard motors. Although the two-cycle engine has an advantage in providing a less complicated, higher specific output structure than a four-cycle engine, there are some environmental concerns with the ability to adequately control the exhaust emission from two-cycle engines. Therefore, four-cycle engines are being considered to replace two-cycle engines in this application.

There are some specific problems in connection with the use of four-cycle engines in outboard motors that are unique to this specific application. One of these has to do with the orientation of the engine in the power head. In most conventional applications for four-cycle engines, the crankcase chamber is positioned at the lower end of the engine and the cylinders extend generally vertically upwardly from the crankcase chamber. With an outboard motor application, however, the engine is generally mounted so that the crankshaft rotates about a vertically extending axis. This is done to facilitate connection of the crankshaft to the drive shaft which drives the propulsion unit in the lower unit portion of the outboard motor.

In order to achieve higher specific outputs for four-cycle engines to make them more feasible to replace two-cycle engines, such arrangements as overhead valves and overhead cam shafts are frequently employed. This raises additional problems due to the vertical disposition of the crankshaft.

For example, it is generally the practice to vent blow-by gases from the engine crankcase chamber to the engine induction system so as to avoid emission of hydrocarbons to the atmosphere. By so recirculating the blow-by gases back to the combustion chamber, any hydrocarbons can be burned and oxidized so as to reduce unwanted hydrocarbon emissions. A wide variety of types of crankcase ventilating systems are employed for this purpose.

These systems generally, however, rely on the vertical disposition of the cylinder bore with the valve chamber above the crankcase chamber for their effective operation.

Where the engine is disposed horizontally, different types of ventilation systems are required.

It is, therefore, a principal object of this invention to provide an improved crankcase ventilation and blow-by system for a four-cycle outboard motor.

It is a further object of this invention to provide an improved and simplified four-cycle crankcase ventilating system that facilitates utilization with outboard motors.

Although the return of the blow-by gases and crankcase ventilating gases to the combustion chamber for combustion is useful in reducing hydrocarbon emissions, there is a risk that because of the horizontal disposition of the cylinder that oil may also be drawn through this ventilating system and delivered to the combustion chamber. This can give rise to undesirable exhaust gas constituents and also can cause the oil consumption of the engine to become unacceptably high.

It is, therefore, a still further object of this invention to provide an improved crankcase ventilating system and oil separator arrangement for use in four-cycle outboard motors.

SUMMARY OF THE INVENTION

This invention is adapted to be embodied in an outboard motor that is comprised of a power head having a powering internal combustion engine and a surrounding protective cowling. A drive shaft housing lower unit depends from the power head and journals a drive shaft. Also contained within the lower unit is a watercraft propulsion device and a transmission for driving the watercraft propulsion device from the drive shaft for powering an associated watercraft. The engine is mounted in the power head so that its crankshaft rotates about a vertically extending axis within a crankcase chamber. The crankcase chamber is formed at one end of a horizontally extending cylinder bore which is closed at the other end by a cylinder head assembly. A valve actuating mechanism is contained within a valve chamber formed in the cylinder head for operating the valves that are contained therein and which control the admission of a charge to the cylinder bore and the discharge of burnt combustion products in the cylinder bore. An oil path arrangement is provided for permitting oil to flow to the valve chamber and drain back from the valve chamber to the crankcase chamber. A crankcase ventilating conduit extends from an upper area of the crankcase chamber to an induction system that delivers at least an air charge to the combustion chamber so that crankcase ventilating gases will be returned to the combustion chamber for further combustion therein. An oil separator is positioned in the crankcase ventilating conduit externally of the engine and has an oil drain that drains oil back to the crankcase chamber through the oil path arrangement that connects the valve chamber with the crankcase chamber.

DETAILED DESCRIPTION OF THE PREFERRED EMBODIMENT

Figure 1:
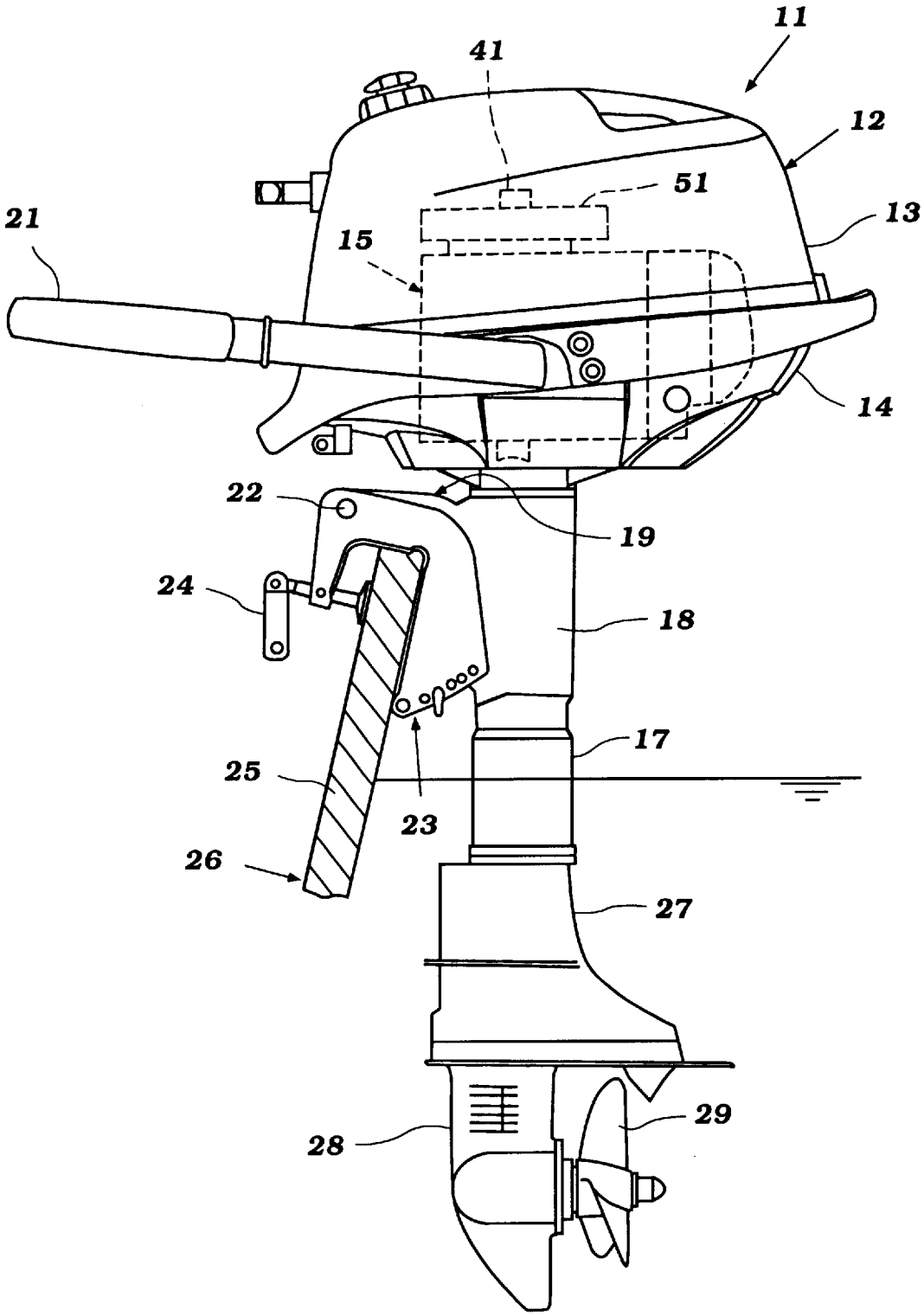
FIG. 1 is a side elevational view of an outboard motor constructed in accordance with an embodiment of the invention, as attached to the transom of a watercraft, which is shown partially and in cross-section.

Referring now in detail to the drawings and initially to FIG. 1, an outboard motor constructed in accordance with an embodiment of the invention is identified generally by the reference numeral 11. The outboard motor 11 has a power head that is comprised of a protective cowling, indicated generally by the reference numeral 12, The protective cowling is comprised of a main cowling member 13, which may be formed from a relatively lightweight rigid material such as a molded fiberglass reinforced resin or the like, and a lower tray portion 14, formed from a slightly heavier but still lightweight material such as an aluminum alloy or the like. The main cowling member 13 is detachably connected to the tray 14.

An internal combustion engine shown in phantom in FIG. 1 and which is shown in full detail in the remaining figures is indicated generally by the reference numeral 15 and is contained within the protective cowling 12. As will become apparent from the description, the engine 15 is supported so that its crankshaft 16 rotates about a vertically extending axis. This is done so as to facilitate the driving of a driveshaft (not shown) that is contained and journaled within a driveshaft housing 17 that depends from the power head. This driveshaft housing is supported for rotational movement within a collar 18 of a bracket assembly 19 for steering about a vertically disposed axis. A tiller 21 is affixed to the tray portion 14 for this steering motion.

The bracket assembly 19 is pivotally connected by means of a pivot pin 22 to a clamping bracket, indicated generally by the reference numeral 23. The clamping bracket 23 carries a clamping device 24 for affecting detachable connection to a transom 25 of the hull of an associated watercraft, indicated generally by the reference numeral 26.

Tilting movement of the outboard motor about the pivot pin 24 from a normal drive position as shown to a tilted up out-of-the-water position permits trailering of the watercraft and/or permits the outboard motor 11 to be stored out of the water while still attached to the hull 25.

A lower unit comprised of an upper housing member 27 and a lower housing member 28 depends from the driveshaft housing 17. A transmission of a known type is contained within this lower unit housing member 28 and is driven by the aforenoted driveshaft. This transmission may include a forward neutral transmission although with a type of outboard motor illustrated, reverse drive may be accomplished by rotating the tiller 21 to a rearwardly facing position. In either event, this transmission drives a propeller 29 for propelling the watercraft 26 in a known manner.

The aforedescribed construction of the outboard motor 11 per se is primarily to permit those skilled in the art to understand the environment in which the invention is utilized. The actual physical structure of the outboard motor may be of any type known in his art and may include those in which the steering is accomplished by connecting the driveshaft housing 17 to a swivel bracket through a steering shaft.

Referring now to the remaining figures and initially primarily to FIG. 2, the engine 15 will be described in more detail. The engine 15 is, in the illustrated embodiment, of the inline type and includes a cylinder block 31 which forms one or more aligned cylinder bores 32, as seen in several of the remaining figures. In the illustrated embodiment, the engine 15 operates on a four-cycle principle. Although the invention is described in conjunction with a four-cycle inline type engine, the number of cylinders and cylinder placement may be of any desirable type. However, the invention has particular utility in conjunction with typical outboard motor applications where the cylinder bores 32 extend generally horizontally regardless of their layout.

A cylinder head assembly 33 is affixed to the cylinder block 31 in a suitable manner and closes one end of the cylinder bore 32. A valve mechanism is mounted in the cylinder head assembly 33 and is operated by a suitable operating mechanism contained within a valve chamber 34 that is closed by a valve cover 35. This valve mechanism, indicated generally by the reference numeral 36, will be described in more detail shortly.

Figure 3:
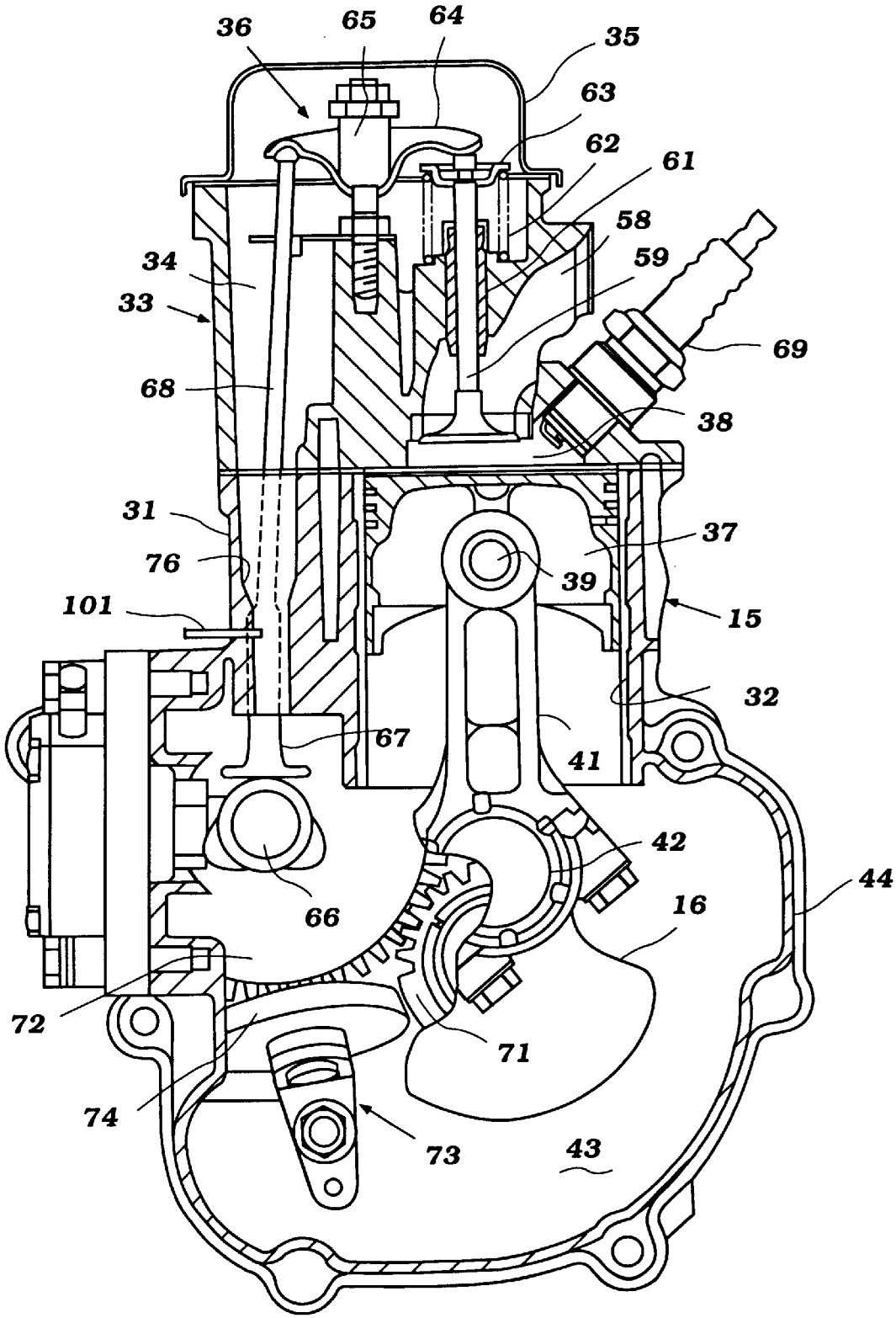
FIG. 3 is a further enlarged cross-sectional view of the engine in the power head taken through the axis of its cylinder bore along a plane parallel to the plane of FIG. 2.
Figure 4:
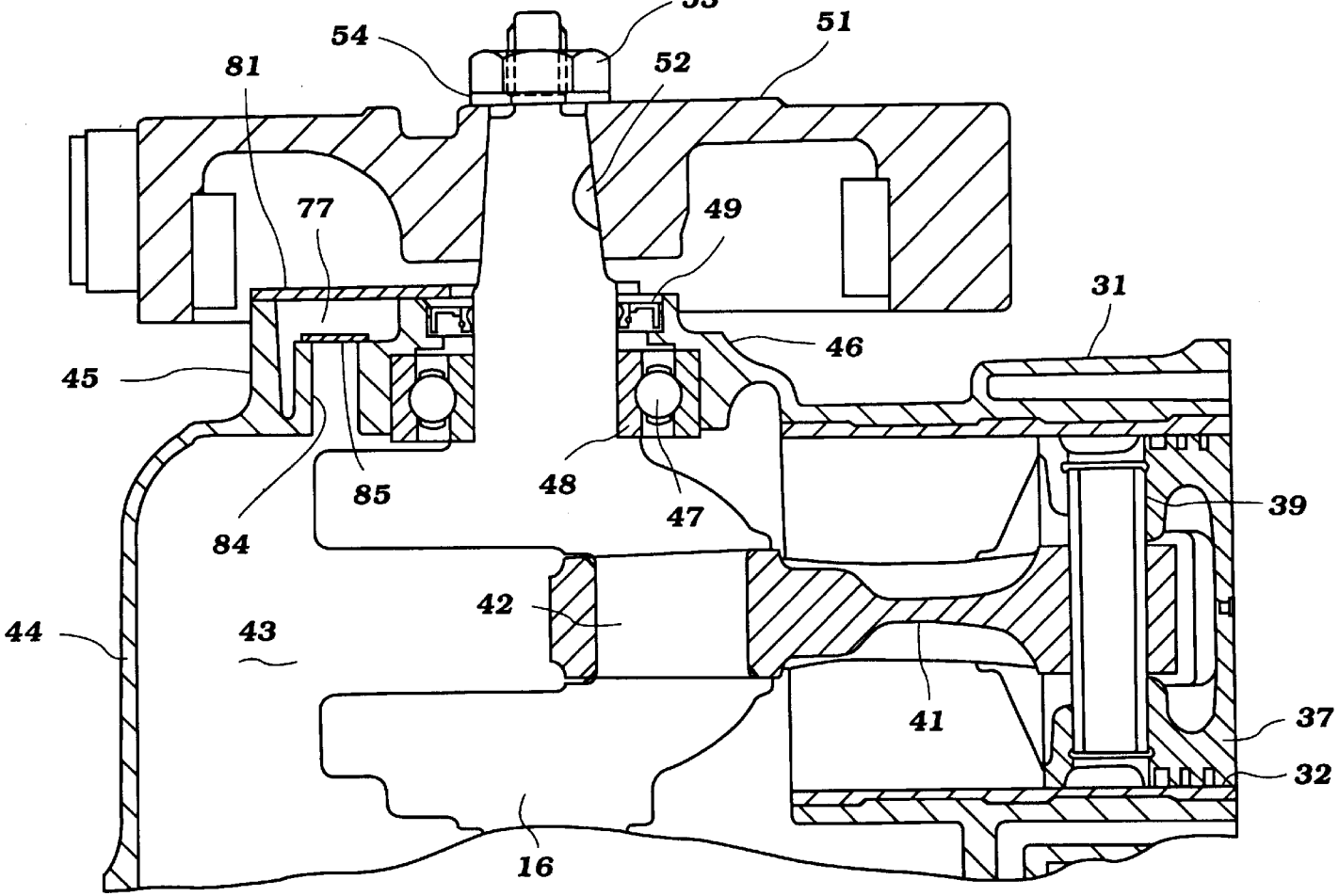
FIG. 4 is a yet further enlarged cross-sectional view taken along the line 4—4 of FIG. 2.
Figure 5:
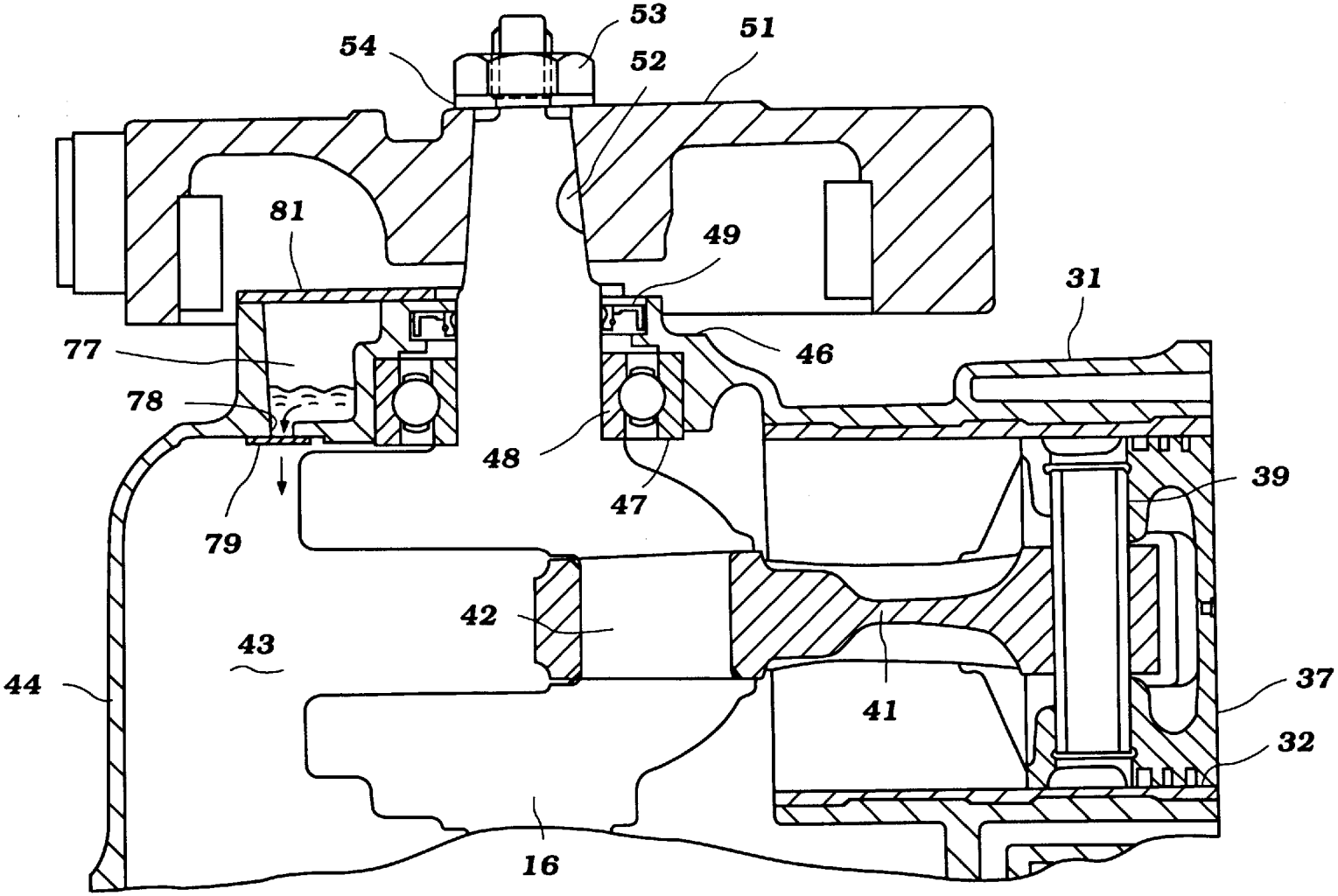
FIG. 5 is a yet further enlarged cross-sectional view taken along the line 5—5 of FIG. 2.

Referring now primarily to FIGS. 3–5, it will be seen that a piston 37 reciprocates in each cylinder bore 32 and cooperates with the aforenoted cylinder head assembly 33 to form the respective combustion chamber 38. The piston 37 is connected by means of a piston pin 39 to the upper or small end of a connecting rod 41. The lower end of the connecting rod 41 is journaled on a throw 42 of the crankshaft 16.

The crankshaft 16 rotates in a crankcase chamber 43 which is formed by the cylinder block 31 and more specifically by a crankcase portion 44 thereof. A boss 45 (FIGS. 4 and 5) is formed at the upper end of the crankcase chamber 43 by an end wall member of the crankcase member cylinder block assembly, which wall member is indicated generally by the reference numeral 46. A bearing 47 is provided in this wall 46 member and has an inner race 48 that journals the upper portion of the crankshaft 16. As may be seen, the crankshaft 16 extends through this wall member 46 and beyond the boss 45. An oil seal 49 is contained within the boss 46 for preventing oil leakage from the bearing 47 through the wall opening through which the crankshaft 16 extends.

A flywheel 51, which may include a flywheel magneto, is affixed to the upper end of the crankshaft 16 by means of a key 52, nut 53, and washer 54.

An induction system, that includes an intake silencer device 55 draws atmospheric air from within the protective cowling and delivers it to the engine cylinders is provided. This induction silencer device 55 supplies the intake air and, if desired, fuel through a suitable charge-forming device to the engine cylinders through a charge former 56 and intake manifold 57.

This intake manifold 57 communicates with the engine combustion chamber 38 through an intake passage 58 (FIG. 3) formed in the cylinder head 33. This intake passage 58 terminates at an intake port and intake valve seat which is valved by a poppet-type intake valve 59. The poppet valve 59 forms part of the valve train 36 previously referred to.

The intake valve 59 is slidably supported within a valve guide 61 and is normally urged to its closed position by a coil spring assembly 62. The spring assembly 62 acts against the cylinder head and a keeper retainer assembly 63 that is affixed to the upper end of the stem of the intake valve 59.

The valve mechanism 36 includes a rocker arm 64 that is mounted on a pivotal support 65 in the cylinder head valve chamber 34. This rocker arm 64 is actuated by the lobe of a cam shaft 66 that is journaled for rotation in the crankcase chamber 43 in a suitable manner. A tappet 67 and push rod 68 transmit motion to the rocker arm 64 to operate it.

The charge which is admitted to the combustion chamber 38 is fired by a spark plug 69 through an ignition system which may include the aforenoted magneto generator 51.

The burnt charge is then discharged through an exhaust passage that is also formed in the cylinder head 33 and which is operated by a further push rod and rocker arm assembly of the type shown in FIG. 3. Since these mechanisms are basically well-known in the art, a further description of this mechanism is not believed to be necessary to permit those skilled in the art to practice the invention.

The cam shaft 66 is driven by a timing gear arrangement which is also shown in FIG. 3 and which now will be described by reference thereto. As may be seen, the crankshaft 16 has a first cam drive gear 71 affixed for rotation with it. This is rotatably engaged with a timing cam shaft gear 72 that is fixed to the cam shaft 66 and which will drive it at one-half crankshaft speed, as is well known in this art.

The crankcase chamber 43 may hold oil in the lower end thereof. The engine is lubricated by a splash lubricating system and this includes an oil slinger 73 that is mounted on a further gear 74 which is enmeshed with the cam shaft drive gear 72 so as to rotate and pickup oil from the crankcase chamber and throw it through the engine for splash-type lubrication.

Figure 7:
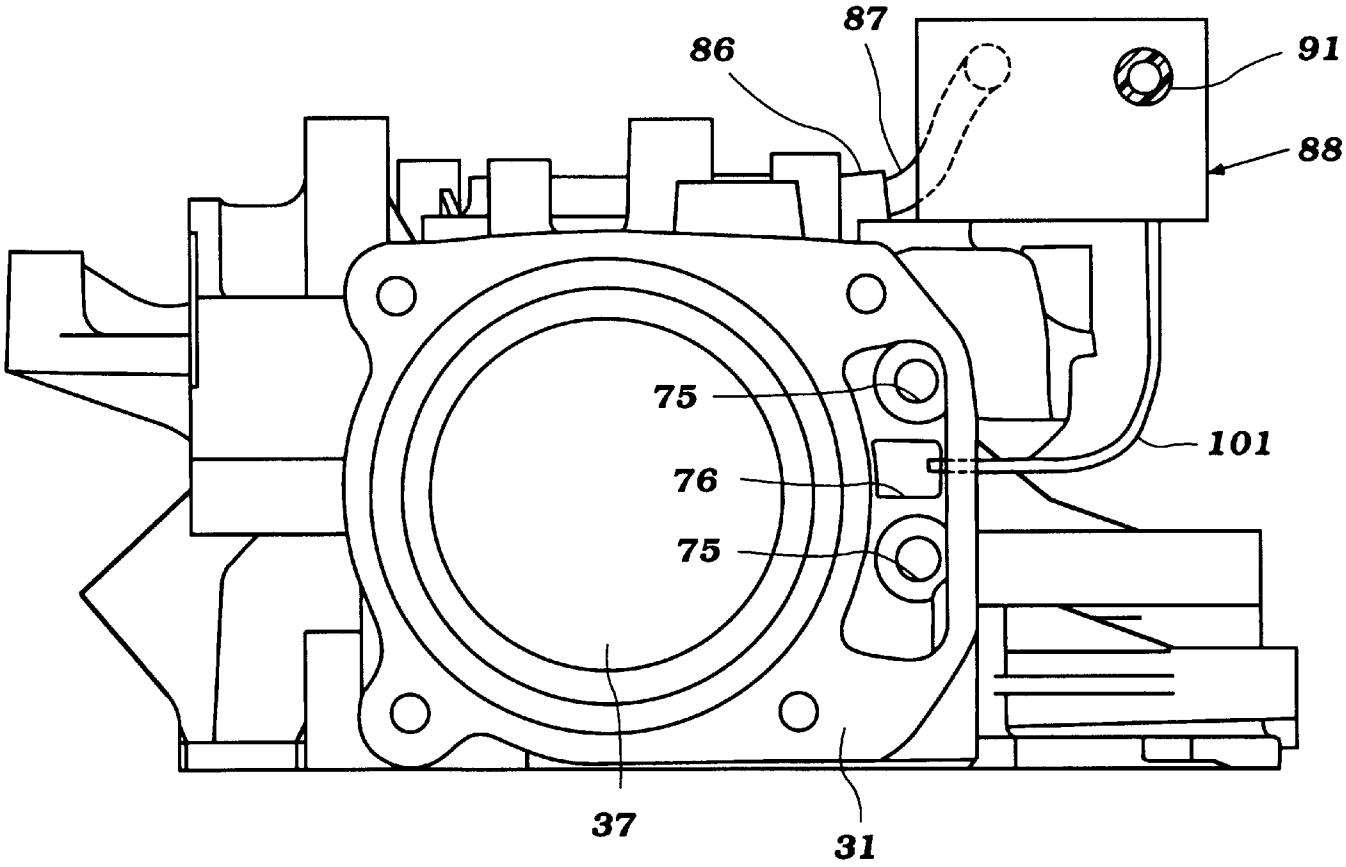
FIG. 7 is a view looking in the direction of the arrow 7 of FIG. 2 with the cylinder head assembly removed so as to more clearly show the relationship of the crankcase ventilating passages as well as the oil return from the oil separator.

The tappet 67 and push rod 68 for each of the intake and exhaust valves pass through openings including the openings 75 best shown in FIG. 7. These openings 75 are disposed on opposite sides of a further lubrication passage and drain passage opening 76. Oil may pass through these passages to the valve mechanism and valve chamber 38 for their lubrication and then drain back to the crankcase chamber 43 for recirculation.

There is additionally provided a ventilating arrangement for ventilating the crankcase chamber 43 and for delivering the blow-by gases and ventilating gases to the combustion chamber 38 for further combustion therein so as to reduce the emission of unburned hydrocarbons. This mechanism will now be described in detail by initial reference to FIGS. 4–6.

A ventilating air chamber 77 is formed in the wall member 46. This ventilating chamber 77 communicates with the crankcase chamber 43 through a small opening 78. In order to preclude the flow of lubricant from the crankcase chamber 43 into the ventilating air chamber 77 through the opening 78, a check valve 79 is provided on the inner side of the wall 46. This check valve 79 will close when the outboard motor is tilted up and prevent oil from flowing into the ventilating air chamber 77. This ventilating air chamber 77 is closed on the outer surface of the wall 46 by a cover plate 81 that is held in place by threaded fasteners 82 (FIG. 2).

When the outboard motor is tilted back up from the position shown in FIG. 4 to the position shown in FIG. 5, the relatively light check valve 79 will open and permit the oil to drain back.

The desirability of permitting pressure relief and ventilating air flow through the crankcase chamber 43 is well known. As has been noted, the air ventilating chamber 77 is utilized for this purpose and provides a much simpler ventilation system than those normally employed.

Figure 6:
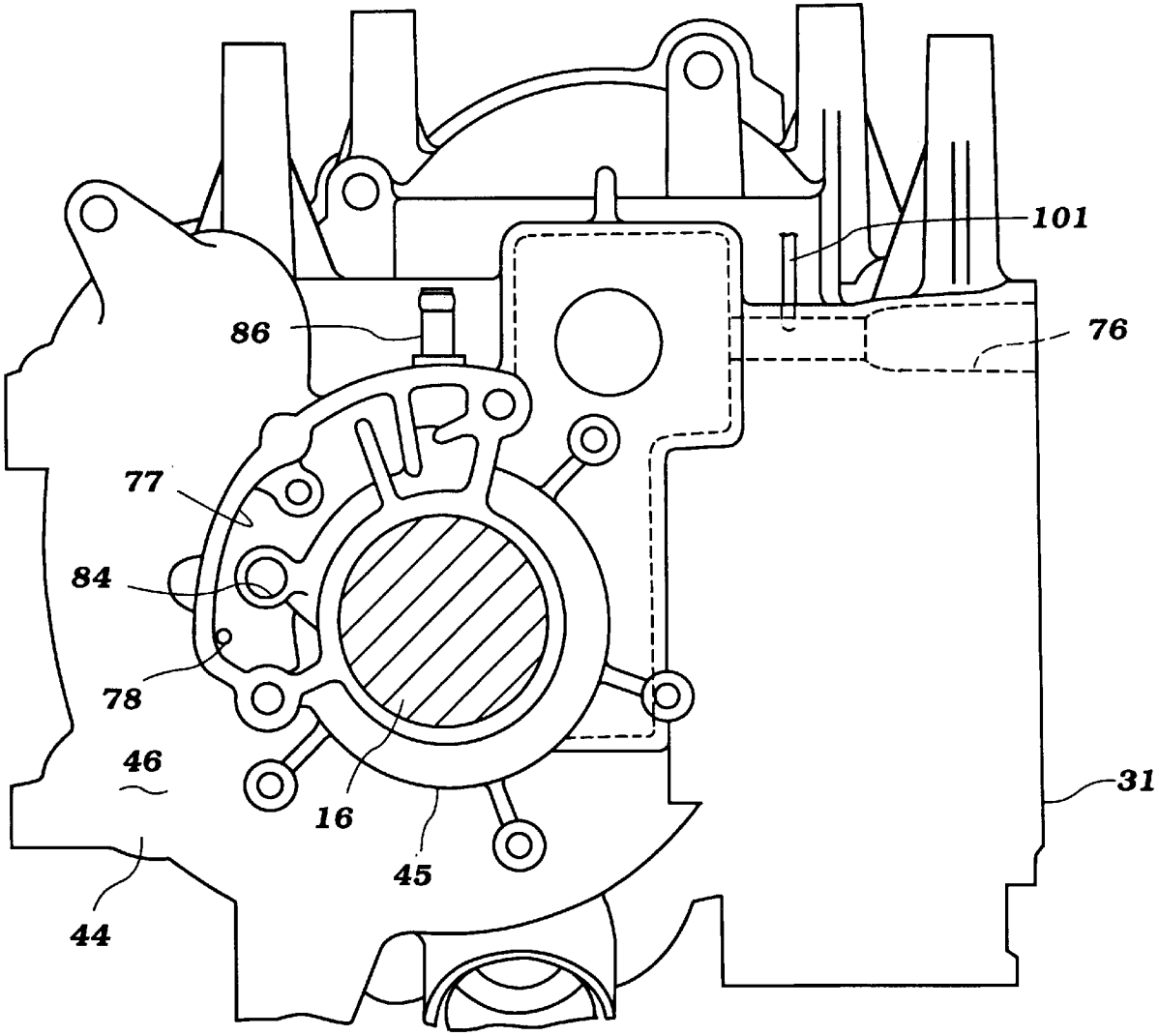
FIG. 6 is an enlarged view looking in the same direction as FIG. 2 and showing the cover of the crankcase ventilating discharge removed.

As may be seen in FIGS. 4 and 6, the wall member 46 is provided with a further boss portion 83 that is spaced radially from the axis of rotation of the crankshaft 16 less than the distance of the wall aperture 78. This boss portion is also disposed vertically above the aperture 78 when the outboard motor 11 is tilted up. A ventilating passage 84 is formed in this boss 83 and is positioned quite close to the bearing 47 so as to minimize the exposure to lubricant when the engine is in the tilted up position.

To further assist in ensuring that lubricant will not flow into the air ventilation chamber 77 through the passage 84, a relatively light check valve 85 is provided for closing the upper end of the passage 84. This light check valve 85 will open when pressure occurs in the crankcase 43 and permit the blow-by gases to escape through a system which will now be described by primary reference to FIGS. 2, 6 and 7. As will become apparent, when the engine is running, the reduced pressure. in the intake system will assist in opening of the check valve 85.

Figure 2:
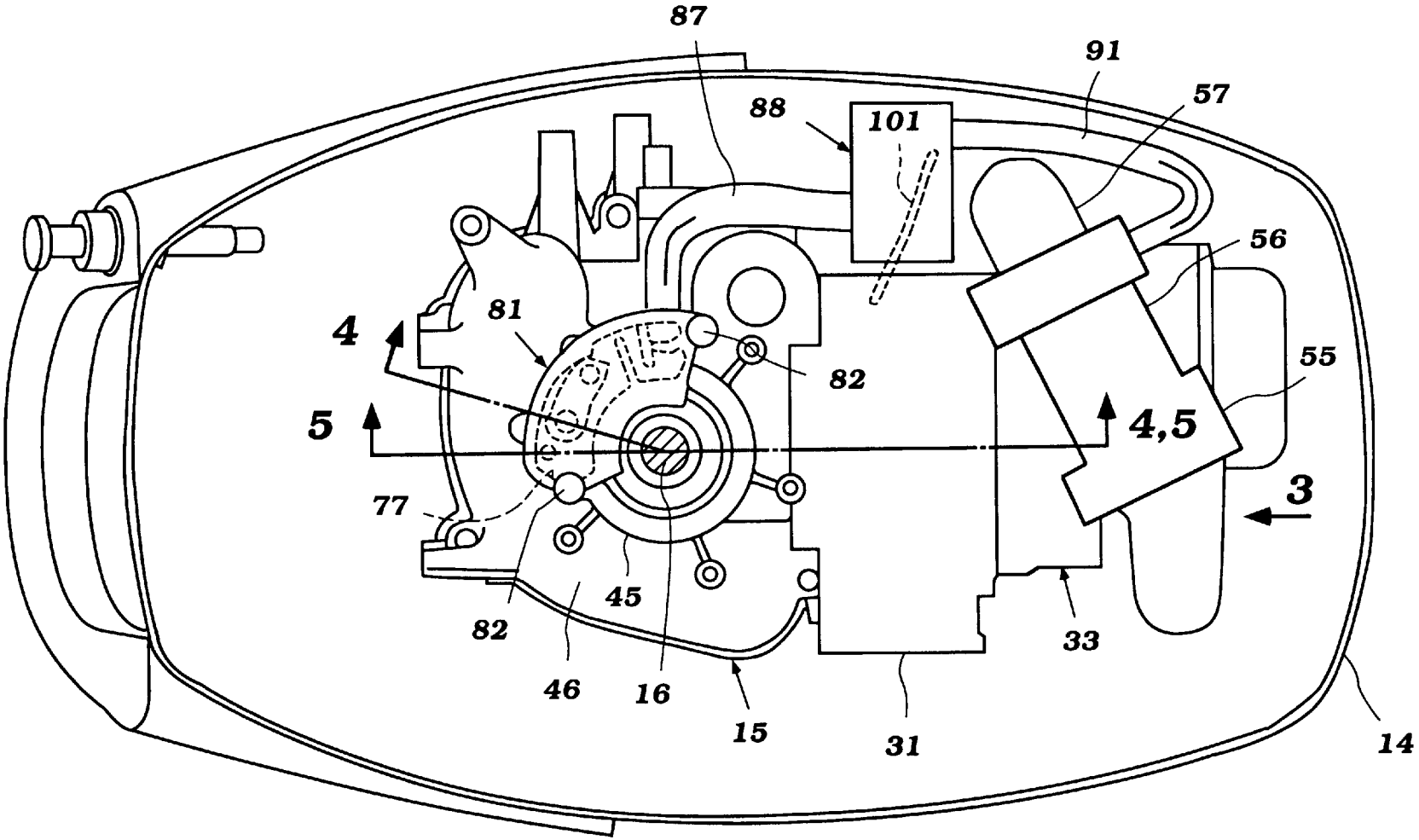
FIG. 2 is an enlarged top plan view of the power head of the outboard motor with a portion of the cowling removed so as to more clearly show the engine arrangement.

Referring now specifically to FIG. 2, the end wall member 46 is provided with a nipple 86 to which one end of a crankcase ventilation hose 87 is connected. The other end of this hose is connected to a second, external vapor separator, indicated by the general reference numeral 88. It should be noted that the chamber 77 acts as a first, internal vapor separator to separate and return oil to the crankcase chamber 43. The construction and operation of the external separator 88 will be described shortly by primary reference to FIG. 8.

Figure 8:
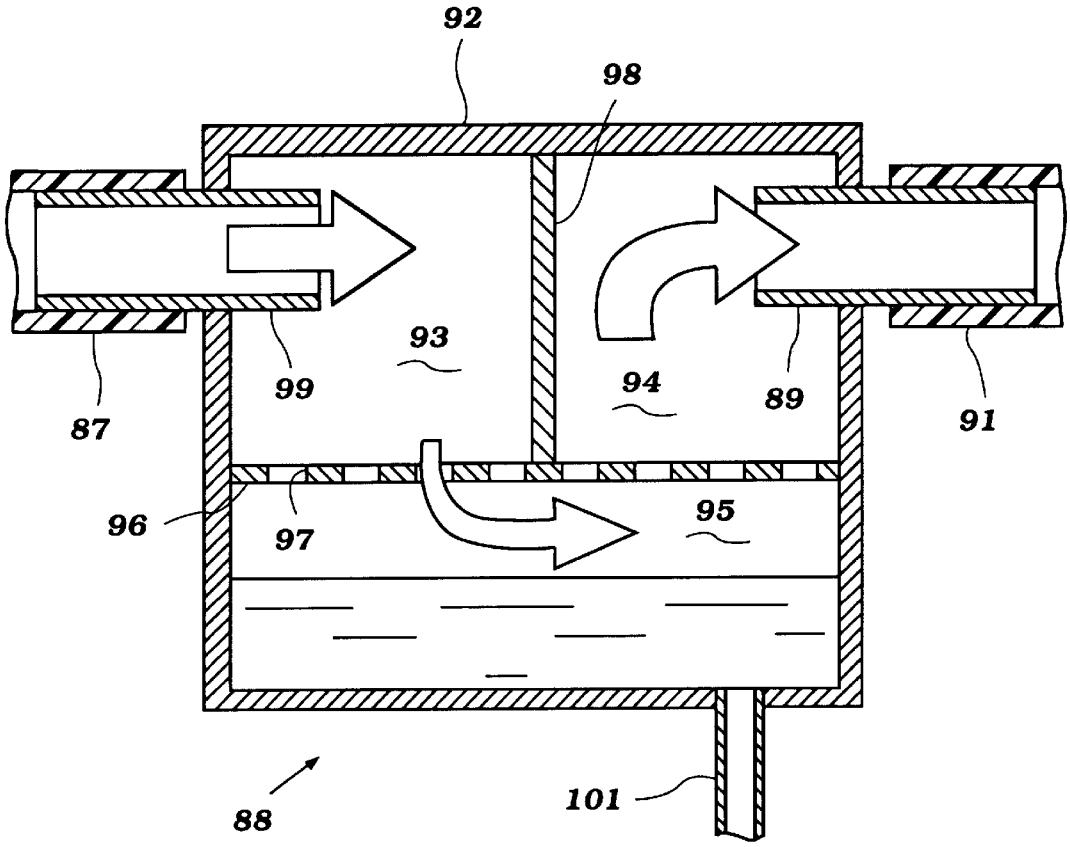
FIG. 8 is an enlarged cross-sectional view taken through the oil separator.

The external vapor separator has an outlet nipple, identified at 89 in FIG. 8 to which a hose 91 is connected. The hose 91 is in turn connected to a nipple on the air inlet silencing device 35 so that crankcase and blow-by gases may flow in the direction indicated by the arrows in FIGS. 2 and 8 into the induction system. These crankcase gases will then be delivered to the combustion chamber of the engine for burning and purification before discharge to the atmosphere along with the other exhaust gases to the engine.

Referring now specifically to FIG. 8, the construction of the external vapor separator 88 will be described. It includes an outer housing 92 that is divided into three chambers 93, 94, and 95 by a horizontally-extending perforated wall 96 having openings 97 and a vertically extending imperforate wall 98.

An inlet nipple 99 receives the discharge end of the first crankcase ventilating hose 87 so that the crankcase ventilating and blow-by gases enter the chamber 93. The gasses then pass downwardly through the openings 97 into the chamber 95. Because of this reversal in direction and contraction and expansion in flow area, oil particles will condense out in the chamber 95 as shown by the oil level line therein.

The gases then flow upwardly through the perforation 97 from the chamber 95 to the chamber 94. Here they exit to the hose 91 through the outlet nipple 89.

As best seen in FIGS. 2 and 7, a more rigid conduit 101 extends from the lower wall of the chamber 95 in a downward direction where it enters the cylinder block cavity 76 that communicates the valve chamber 34 with the crankcase chamber 43. Thus, the condensed liquid will be delivered back to the crankcase chamber 43 and no lubricant will be lost from the system through the crankcase ventilation and blow-by gas treatment arrangement.

Thus, from the foregoing description, it should be readily apparent that the described construction provides a very effective ventilating arrangement for ventilating the crankcase while ensuring against loss of lubricant through this system. Of course, the foregoing description is that of a preferred embodiment of the invention and various changes and modifications may be made without departing from the spirit and scope of the invention, as defined by the appended claims.

I claim:

1. An outboard motor comprised of a power head having a powering internal combustion engine and a surrounding protective cowling, a drive shaft housing lower unit depending from said power head and journalling a drive shaft, a watercraft propulsion device and a transmission for driving the watercraft propulsion device from the drive shaft for powering an associated watercraft contained within said lower unit, said engine being mounted in said power head so that an engine crankshaft rotates about a vertically extending axis within a crankcase chamber of said engine, said crankcase chamber being formed at one end of a horizontally extending cylinder bore, said crankcase chamber defining an oil collecting area for containing oil, a cylinder head assembly closing the other end of said cylinder bore, a valve actuating mechanism contained within a valve chamber formed in said cylinder head for operating valves contained therein and which control the admission of a charge to said cylinder bore and the discharge of burnt combustion products from said cylinder bore, a slinger mechanism driven by said crankshaft for throwing oil contained in said oil collecting area of said crankcase chamber, an oil path arrangement for permitting oil thrown by said slinger mechanism to flow to said valve chamber and drain back from said valve chamber to said crankcase chamber, a crankcase ventilating conduit extending from an upper area of said crankcase chamber to an induction system that delivers at least an air charge to the combustion chamber so that crankcase ventilating gases will be returned to said cylinder bore for further combustion therein, and an oil separator positioned in said crankcase ventilating conduit externally of said engine and having an oil drain that drains oil back to said crankcase chamber.

2. An outboard motor as set forth in claim 1 wherein the oil drain drains oil back to the crankcase chamber through the oil path arrangement that connects said valve chamber with said crankcase chamber.

3. An outboard motor as set forth in claim 1 further including a second oil separator for separating oil from the crankcase gasses and having an oil drain that drains oil back to the crankcase chamber.

4. An outboard motor as set forth in claim 3 wherein the first mentioned and second oil separators are disposed in series in the crankcase ventilating conduit.

5. An outboard motor as set forth in claim 3 wherein the second oi separator is formed within the body of the engine.

6. An outboard motor as set forth in claim 5 wherein the crankcase chamber is defined at one end by a wall member through which one end of the crankshaft extends, a bearing fixed in said wall member and journaling said crankshaft end, the second oil separator being formed at least in part an air chamber defined by said wall contiguous to said bearing, an opening in said wall member permitting communication between said crankcase chamber and said air chamber, and a check valve for controlling the flow through said opening.

7. An outboard motor as set forth in claim 6, wherein the check valve precludes flow from the crankcase chamber into the air chamber and permits flow from the air chamber into the crankcase chamber.

8. An outboard motor set forth in claim 6, wherein the check valve permits flow from the crankcase chamber into the air chamber and precludes flow from the air chamber into the crankcase chamber.

9. An outboard motor as set forth in claim 6, wherein there is provided a further aperture in the wall member communicating the crankcase chamber with air chamber.

10. An outboard motor as set forth in claim 9, further including a check valve for controlling the flow through the further aperture.

11. An outboard motor as set forth in claim 9, wherein one of the check valves permits flow from the crankcase chamber to the air chamber and the other of the check valve permits flow from the air chamber to the crankcase chamber.

12. An outboard motor as set forth in claim 11, wherein the apertures are spaced circumferentially from each other relative to the crankshaft axis.

13. An outboard motor as set forth in claim 9 wherein the first mentioned and second oil separators are disposed in series in the crankcase ventilating conduit.

* * * * *